United States Patent [19]

Mecozzi

[11] Patent Number: 4,567,733

[45] Date of Patent: Feb. 4, 1986

[54] ECONOMIZING AIR CONDITIONING SYSTEM OF INCREASED EFFICIENCY OF HEAT TRANSFER SELECTIVELY FROM LIQUID COOLANT OR REFRIGERANT TO AIR

[75] Inventor: Walter P. Mecozzi, North Tonawanda, N.Y.

[73] Assignee: Hiross, Inc., Niagara Falls, N.Y.

[21] Appl. No.: 539,078

[22] Filed: Oct. 5, 1983

[51] Int. Cl.[4] ..... F25B 25/00

[52] U.S. Cl. ..... 62/175; 62/332; 165/140

[58] Field of Search ..... 62/332, 175; 165/140

[56] References Cited

U.S. PATENT DOCUMENTS

| | | | |
|---|---|---|---|
| 3,024,008 | 3/1962 | Blum | 165/22 |
| 3,237,415 | 3/1966 | Newton | 62/3 |
| 3,276,516 | 10/1966 | Japhet | 165/27 |
| 4,256,475 | 3/1981 | Schafer | 165/140 X |
| 4,313,310 | 2/1982 | Kobayashi et al. | 62/332 X |

*Primary Examiner*—William E. Tapolcai

*Attorney, Agent, or Firm*—Raymond F. Kramer

[57] ABSTRACT

An air conditioning system which incorporates evaporator coils for extracting heat from air with a liquefiable gas refrigerant, and cooling coils containing a liquid coolant, such as an aqueous ethylene glycol solution, that has been cooled by cold outside air, includes such coils joined in heat transfer relationship to a multiplicity of common heat transfer fins. Due to the improved heat transfer because of a larger fin area transferring heat from either the refrigerant-containing coils or the coolant-containing coils when either refrigerant or coolant is passed through its coils, more coolant coils can be joined to the fins, so that more effective air conditioning is obtainable when the air conditioning system is in the economizing mode (with the compressor being turned off and the cooled liquid coolant being circulated through its cooling coils). Further improvements in the structure and efficiency of the air conditioning system are obtainable when dual such systems are employed in conjunction, with the liquid coolant being cooled in a single heat exchanger by outside air and being circulatable through either or both sets of cooling coils of the component system and through either or both condensers for the refrigerant, to condense the refrigerant.

6 Claims, 3 Drawing Figures

Figure 1:
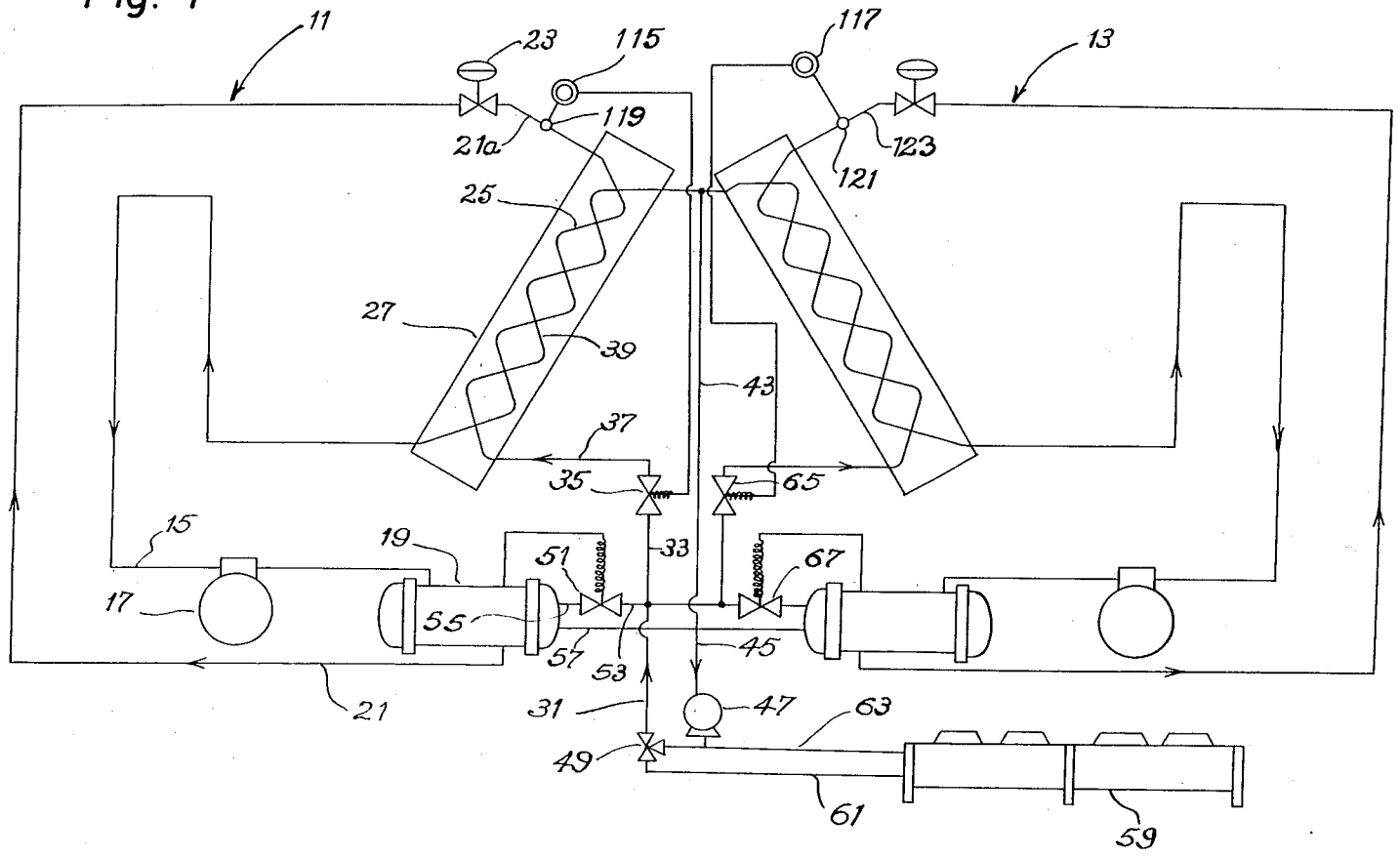

ECONOMIZING AIR CONDITIONING SYSTEM OF INCREASED EFFICIENCY OF HEAT TRANSFER SELECTIVELY FROM LIQUID COOLANT OR REFRIGERANT TO AIR

This invention relates to air conditioning. More specifically, it relates to an air conditioning system in which an economizing unit is employed which cools a circulating liquid by means of heat transfer from such liquid to cold outside air and then cools room air by heat exchange with such liquid. In such system conventional air conditioning means are provided so that when the outside air temperature is not low enough for effective cooling by the economizing unit satisfactory air conditioning can still be obtained.

Conventional air conditioners and air conditioning systems, which utilize compressors, condensers, evaporators and various controls for cooling (and sometimes heating) air by means of a liquefiable gas refrigerant, such as dichlorodifluoromethane or other suitable chlorofluorinated lower hydrocarbon (available commercially as Freons® from E. I. DuPont DeNemours & Co., Inc.), have long been accepted for conditioning air in residential, office, business and industrial buildings. With increasing energy costs and needs for energy conservation, searches have been made for systems that would operate at higher efficiencies.

It has been known to utilize supplementary systems for transferring heat from cold outside air to a circulating fluid which may be employed as a coolant in conjunction with a conventional air conditioning system or in replacement thereof when the outside air temperature is low enough. When both conventional and economizer air cooling systems of the type mentioned are utilized together a set of economizer coils and corresponding heat transfer fins will be upstream of a conventional set of evaporator coils, with accompanying fins, so that the air to be cooled will pass over the economizer coils before having heat extracted therefrom by the conventional evaporator coils. In the prior art it has also been taught that one can employ cooling coils through which separate refrigerant streams pass, but with such coils or sets thereof both being thermally connected to common heat transfer fins. Also, different heating or cooling coils, containing different heating or cooling fluids, have been associated with common fins for joint use to heat or cool indoor spaces. However, prior to the present invention it was not known to effectively and efficiently combine separate circulating systems for conventional liquefiable gas refrigerant and for a liquid coolant cooled by cold outside air so that either refrigerant or coolant flows through the appropriate coils could be caused, depending on the demand for conditioned air and the outside temperature, and heat could be extracted from the air to be conditioned, by fins that are common to both types of coils.

In accordance with the present invention an air conditioning system comprises separate circulating systems for a liquefiable gas refrigerant that is cooled by compression, condensation and evaporation, and for a liquid coolant that is cooled by cold outside air, each of which circulating systems includes cooling coils through which the respective refrigerant and coolant pass, and a multiplicity of heat transfer fins, joined to both such cooling coils, and adapted selectively to transfer heat to circulating fluids in such coils from air to be cooled by the air conditioning system. In a preferred embodiment of the invention another such air conditioning system or apparatus is included, so that a dual air conditioning apparatus is provided in which both systems can be used simultaneously to cool the air by refrigerant or coolant therein or either such system or apparatus may be so employed, means are provided for preventing passing of liquefiable gas refrigerant and liquid coolant through the respective cooling coils at the same time, a single heat exchanger is present for cooling circulating coolant in both systems of the dual apparatus by cold outside air and means are provided for circulating said coolant through either or both of the sets of cooling coils of the component dual apparatuses through which coolant may flow. Also within the invention are such systems wherein multiple pass cooling coils containing refrigerant alternate with similar coils containing coolant, with the number of coolant-containing coils being greater than the number of refrigerant-containing coils. The fins are preferably rectangular in shape and the tubes of the cooling coils are substantially cylindrical and are located in planes at certain angles to the transverse axis of the fins. Preferably, two such described systems are utilized together, with the coolant therein being circulatable to either coolant-containing cooling coil and to either condenser to condense refrigerant therein, and with all the coolant being cooled by cold outside air in a single heat exchanger.

A search for prior art resulted in the findings of the following U.S. Pat. Nos. 2,241,033 (Huggins); 3,024,008 (Blum); 3,237,415 (Newton); 3,276,516 (Japhet); 3,587,731 (Hays); 3,670,522 (Bresin); 3,866,439 (Bussjager et al.); 4,201,065 (Griffin); and 4,167,965 (Rogers). The Huggins patent describes heat transfer plates or fins common to and arranged in heat conducting relation with first and second groups of tubes through which liquid refrigerant from conventional refrigerating apparatus is passed. The Japhet patent relates to an air conditioning system in which water, cooled in an evaporative cooler external to the building to be air conditioned, may be employed as a coolant in air conditioning units in place of or in addition to a conventional refrigerant. The coolant may also be employed to assist in condensing the refrigerant. The Bussjager et al. patent describes a refrigerant evaporator which includes a plurality of separate but intertwined refrigerant circuits which are connectable in alternative groups to refrigerant distributors of a refrigeration system, and which have common heat transfer fins. Both circuits may be employed for high cooling loads or one circuit can be employed when the cooling demand is less. The Griffin patent is similar to the Bussjager et al. patent but relates to heat transfer in a condenser for a refrigeration system. The Rogers patent describes the use of a heat pump in conjunction with a solar collector to heat an enclosure by means of separate circulating systems wherein separate heat transfer coils utilize common fins to increase heat transfer therefrom. Rogers teaches that when cooling of the enclosure is desired, refrigerant from the heat pump and cooled water from a storage tank may both be employed and the coils of their separate systems may have common tube sheets and heat transfer fins attached to them. The other patents found in the search are not considered to be more relevant than those described above and therefore do not warrant further discussion.

From the above summaries of the disclosures of the search patents it appears that common heat transfer fins have been employed for separate air conditioning system cooling coils containing different coolants, and that externally cooled liquid, in a separate cooling system, has been employed to supplement cooling by a refrigerant in an air conditioning apparatus. However, the prior art does not teach the employment of separate circulating systems for liquefiable gas refrigerant and a liquid coolant, such as glycol, (which is cooled by cold outside air), each of which systems includes their separate cooling coils, with the coils being joined to a multiplicity of common heat transfer fins and being adapted selectively to transfer heat to circulating fluids in such coils from the air to be cooled. The art found does not teach the employment of more coolant coils than refrigerant coils, to which heat is transferred from the air to be cooled to common heat transfer fins. Neither does it teach the dual air conditioning system of the invention, wherein each of the dual systems includes both refrigerant and coolant coils and common heat transfer fins, and utilizes a common source of coolant, cooled by cold outside air.

Figure 3:
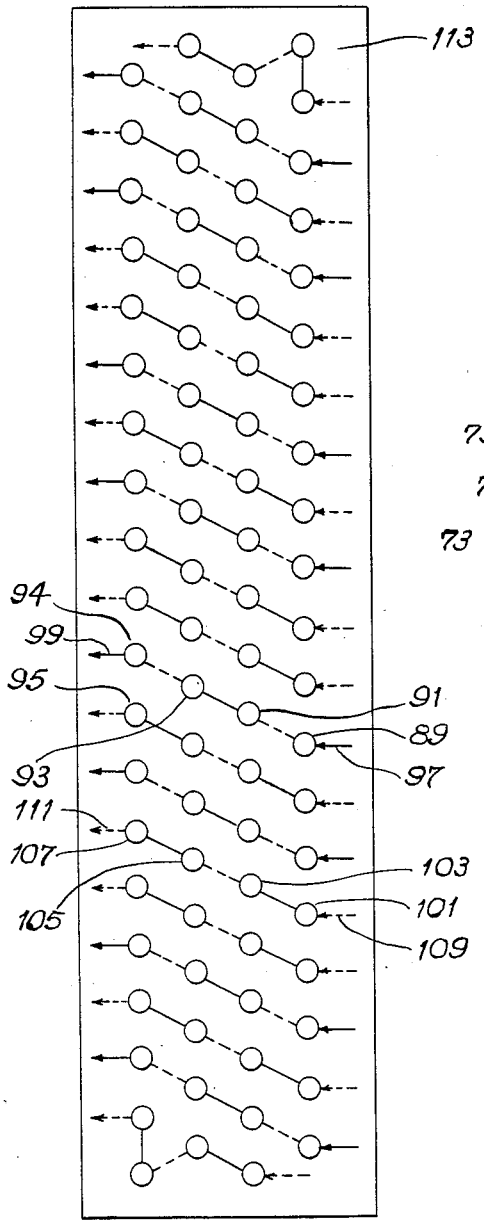
Figure 2:
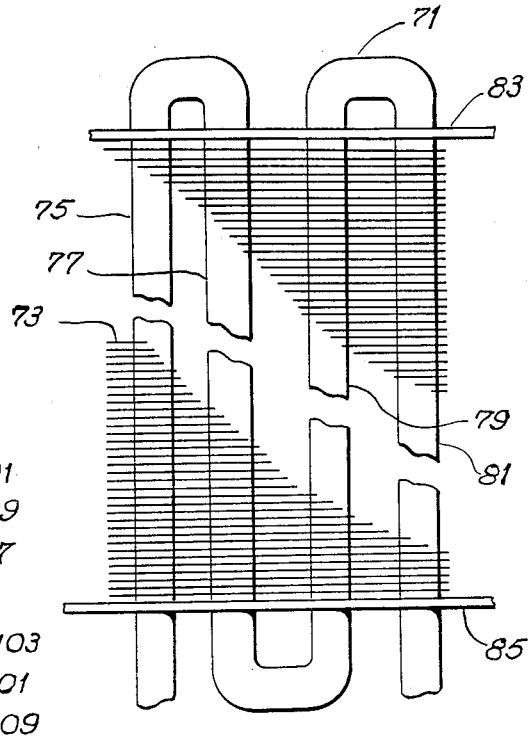

The invention will be readily understood by reference to this specification, including the specific description of preferred embodiments of the invention which follows, taken in conjunction with the drawing in which:

FIG. 1 is a schematic representation of a dual air conditioning system of this invention;

FIG. 2 is a side view of a single multiple pass coil of this invention joined to a pair of tube sheets and a multiplicity of heat transfer fins; and FIG. 3 is a frontal view of a heat transfer fin of an air conditioning system of this invention, schematically showing the flow of liquids through multiple pass coils containing coolant and multiple pass coils containing refrigerant in heat transferring relationship with the fin.

In FIG. 1 dual air conditioning systems 11 and 13 are illustrated. Because such systems are essentialy the same, only one of them will be described in detail and it will be understood that the description applies equally well to the other. In system 11, refrigerant from line 15 is compressed in compressor 17, condensed in condenser 19 and then passes through line 21 and thermal expansion valve 23 to refrigerant coil 25, shown schematically in framing 27, after which the heated refrigerant is passed back to compressor 17 through line 15. Air is blown across refrigerant coil 25, which extracts heat from the air, which air then passes into the space to be conditioned. A fan, which is conventional for blowing the air, is not shown in FIG. 1, and the heat transfer fins associated with the refrigerant coil are also not illustrated in FIG. 1 but are shown in FIGS. 2 and 3.

From a source of coolant, which coolant is preferably an aqueous solution of ethylene glycol (although other liquids may also be employed, such as methanol, brine and water), such liquid flows via lines 31 and 33 through the economizer solenoid valve 35 and line 37 to coolant coil 39 in frame 27. When the coolant is flowing through such coil it can extract heat from air blown across it, thereby conditioning the air being treated, at least with respect to temperature regulation (humidity may be controlled separately). The warm coolant then flows through lines 41, 43 and 45 to pump 47 and through three-way valve 49 back to line 31. When regulating valve 51 opens coolant may flow through tubes (not shown) in condenser 19 via lines 53 and 55 and may return to pump 47 through lines 57 and 45. A single heat exchanger 59 is located outside the building to be air conditioned so that when the outside air is sufficiently cold, as when it is at a temperature in the range of 5° to 9° or 10° C., or lower, the cold outside air, passing over finned heat transfer tubes (not shown) in exchanger 59, will cool coolant therein, which coolant will then flow through line 61 and valve 49, when that valve is open, and ultimately will return to heat exchanger 59 through pump 47 and line 63. When it is desired that the coolant should flow through system 13, valve 35 may be closed and valve 65 may be opened. Similarly, valve 51 may be closed and valve 67 may be opened when it is desired that coolant should be used to cool the condenser of the second system.

In FIG. 2 there is somewhat schematically illustrated a coil 71 of the present invention which may be either a refrigerant coil or a coolant coil. The coil illustrated is of the multiple pass type, making four passes through a heat transfer volume wherein air is cooled by contact with heat transfer fins 73, which are thermally connected to the various tubes, 75, 77, 79 and 81 of the plural pass or multiple pass coil 71. It is noted that tube sheets 83 and 85 are provided near the ends of the tubes of the coil and help to space and support such tubes. In the view illustrated it is seen that the coolant (or refrigerant) enters coil 71 and leaves from it on the same side of tube sheet 85. Other coils, not illustrated in FIG. 2, are also in thermal contact with the same fins 73 that are shown in FIG. 2 and the locations and spacings of such coils are shown in FIG. 3.

In FIG. 3 there are shown eighty tubes in twenty coils or circuits, eight such coils being refrigerant coils and twelve being coolant coils. The coils shown are disposed like that of FIG. 2 with respect to their common fins. In FIG. 3 tubes 89, 91, 93 and 94 are refrigerant tubes through which refrigerant passes in the direction of arrows 97 and 99. Thus, refrigerant enters tube 89 from the position of the viewer, passes backwardly through such tube across to tube 91 (the connection is indicated by a dashed line) and thence to tubes 93 and 94 and out from tube 94, moving in the direction of the viewer, as represented by arrow 99. In the case of tubes 101, 103, 105 and 107 (tube 95 is like tube 107) the coolant enters tube 101 from a position away from the viewer, passes through such tube in the direction of the viewer, passes through tube 103 in a direction away from the viewer and then passes through tubes 105 and 107, leaving tube 107 moving in a direction away from the viewer, which movements are represented by arrows 109 and 111. Thus, the arrows with solid shafts represent movements away from the viewer of FIG. 3 and those arrows with dashed shafts represent movement toward the viewer. Additionally, the solid shaft arrows represent refrigerant and the associated tubes and coils are refrigerant tubes and coils. Similarly, the dashed arrows represent coolant and the associated tubes and coils are coolant tubes and coils. It will be seen that all the tubes and coils are in thermal contact with heat transfer fin 113. Because such fin is elongated rectangular in shape, as illustrated, the coil construction at the ends thereof is adapted to fit the fin shape. For greater strength of the air cooling assembly of the present system the plane of most of the coils of such assembly will be at an angle in the range of 10° to 40°, preferably 15° to 35°, e.g., 30°. Other angles may also be employed, but usually they will be no more than about 45°. Such locations of the coils allows strengthenings of the fins, often facilitates better heat transfer to the air being cooled and provides lower pressure drops across the coils.

Operation of the present air conditioning system is relatively simple. During cold weather, when the outside air temperature is below about 10° C., it will often be desirable to utilize the coolant mode of the system, allowing the passage of aqueous ethylene glycol solution (of strength to be non-freezing at temperatures above −30° C.) through coils like those represented by numeral 39 in FIG. 1. Such coils, which are preferably arranged like those of FIGS. 2 and 3, will normally be in parallel, but under proper circumstances, could be arranged in series or in mixed series-parallel. Because the coolant temperature is limited by the outside air temperature there will usually be more coolant coils than refrigerant coils in the air cooling frame 27 but nevertheless the number of such coolant coils will usually be sufficient so as to be able to meet the full normal cooling demand when the outside air temperature is below a fixed design temperature. Preferably the number of coolant coils will be from 1.2 to 2 times the number of refrigerant coils, more preferably from 1.3 to 1.7 times as many, e.g., 1.5 times as many (as illustrated in FIG. 3). The tubes of the coils will normally be of the same size and the spacings of the tubes apart will generally be substantially uniform. However, it is within the invention to utilize tubes of different sizes and irregular spacings. The tubes will preferably be of copper or other thermally conductive metal, and the fins will preferably be of aluminum.

If the outside air temperature is not low enough then valves 35 and 65 may be closed and reliance may be placed on the refrigeration coils to accomplish cooling in system 11. The coolant liquid may still be employed to cool condenser 19. In some circumstances one may utilize flow of coolant and refrigerant through coils 39 and 25, respectively, in system 11 or may have coolant flow in one system and refrigerant in the other.

When system 11 is shut down, as for repairs, system 13 may be employed instead. Alternatively, when system 13 is shut down the load may be taken up by system 11. Sometimes it may be desirable to employ both systems together, in which case all the refrigerant coils and all the coolant coils can be used together or all the coolant coils with one bank of refrigerant coils or all the refrigerant coils with one bank of coolant coils may be employed. If desired, the coolant coils of one system can be utilized with the refrigerant coils of the other. It is seen that a single heat exchanger is utilized to cool the coolant for employment in both systems but if desired, a plurality of heat exchangers could be so employed. However, one is normally sufficient and results in significant economies.

In normal operation, when the outdoor air temperature is above about 15° C. valves 35 and 65 (FIG. 1) will be closed and the refrigeration cycle(s) will be activated. The coolant pump 47 will preferably be activated when either compressor is on. The condensing temperatures will be maintained by the two-way head pressure control coolant regulating valves 51 and 67.

When outside air temperatures are below 15° C. and not as low as the normal changeover point for complete economizer operation (about 5° to 9° C. outside air temperature, or 10° to 12° C. entering coolant temperature), pump 47 will be activated whenever a control (not shown) senses room air conditioning load. The compressors of both systems will cycle as necessary to meet the room load. When one compressor is off its corresponding valve (identified by numerals 35 and 65) will open, allowing coolant to flow through that circuit. Similarly, when the other compressor is off, the corresponding valve will open. Thus, there has been described prevention of simultaneous flows of coolant and refrigerant through coils 39 and 25, since compressor 17 is the means for forcing refrigerant through condenser 19 and coil 25. Subsequently, an additional mechanism for preventing such simultaneous flows of coolant and refrigerant through the coils which share common heat exchange fins will be described.

When the outside air temperature is below 9°, sometimes below 7° or below 5° C. (depending on the capacity of the air conditioning system, and the room load), the economizer system alone can match the capacity of the refrigeration system. In such case both compressors will be off, both solenoid valves 35 and 65 will be open and pump 47 will be on (except at zero load) and mixing valve 49 will modulate the coolant temperature according to the room load.

The advantages of the present invention are very important and it is considered that they will soon lead to the replacement of prior art air conditioning systems wherein coolant coils or economizers may be employed. Thus, during cold weather air conditioning can be supplied by the present system without the need for the use of power consuming refrigeration compressors. The described system can match the cooling performance of refrigeration systems when outdoor temperatures are below about 10° C. In other coolant or glycol economizer systems wherein cold outside air is used to cool the circulating coolant the economizer coil is normally used to precool the air upstream of the refrigerant evaporator. This causes a lowering of suction pressure and results in increased compressor power consumption. At the same time, it reduces the total refrigeration capacity and increases latent cooling. Often hot gas by-pass valves are necessary to prevent freezing of the evaporator and sometimes larger blower motors are needed to overcome the resistance to flow caused by the upstream positioning of the economizer coil. The system of the present invention eliminates all such problems and, due to the full "interlacing" of the coolant coils with the refrigerant coils, improved heat transfer is obtained in both the economizer and conventional modes. Each coolant circuit is controlled by an independent solenoid valve (35 amd 65, respectively) and such, in conjunction with solid state controls (115 and 117, respectively), can be employed to prevent simultaneous operation of the coolant and refrigeration circuits (although in some instances such simultaneous operation may be desirable). Controls 115 and 117 include sensing means 119 and 121, respectively, for detecting flows in lines **21*a* and 123, respectively. Thus, when refrigerant flows through line 21*a* or line 123 solenoid valve 35 or solenoid valve 65, respectively, will close. However, when no flow is detected in such lines the solenoid valves may be be open to permit flow of liquid coolant through line 37 and coolant coil 39 in frame 27** and/or through the corresponding parts of the second of the dual systems. Among other advantages of the invention are the eliminations of unnecessary dehumidification and subsequent rehumidification when the coolant is employed, which operations are often necessitated when refrigerant is used. Also, the refrigeration compressors may now operate at normal conditions, saving power, and hot gas by-pass valves are not needed. Furthermore, the integrated coil positioning permits the employment of standard fan motors to provide rated air flow, eliminating requirements for increased fan motor horse power.

The invention has been described with respect to various examples and preferred embodiments thereof but it will be understood that it is not limited to these because one of skill in the art, with the present specification and drawing before him, will be able to utilize substitutes and equivalents without departing from the invention.

What is claimed is:

1. A dual air conditioning apparatus which comprises a pair of separate circulating systems for a liquefiable gas refrigerant that is cooled by compression, condensation and evaporation, and for a liquid coolant that is cooled by cold outside air, each of which separate circulating systems includes different air cooling coils through which the respective refrigerant and liquid coolant pass, means for preventing passing of liquefiable gas refrigerant and liquid coolant through the respective cooling coils at the same time, and a multiplicity of heat transfer fins, joined to both such air cooling coils, and adapted selectively to transfer heat to circulating fluids in such coils from air to be cooled by the air conditioning apparatus, such pair of separate circulating systems being incorporated together so that both such systems can be used simultaneously to cool the air by the refrigerant or liquid coolant therein or by either such system being so employed, and which dual air conditioning apparatus comprises a single heat exchanger for cooling circulating liquid coolant by cold outside air, and means for circulating said liquid coolant through either or both of the sets of coolant-containing cooling coils of the component systems.

2. An apparatus according to claim 1 wherein the liquid coolant is aqueous solution of ethylene glycol.

3. An apparatus according to claim 2 which comprises sets of a plurality of multiple pass cooling coils containing refrigerant and of a plurality of multiple pass cooling coils containing coolant, and the multiple pass refrigerant-containing coils alternate with the multiple pass coolant-containing coils of the sets where they are joined to the heat transfer fins so as to improve the heat transfer efficiency when either refrigerant or coolant is circulated through its cooling coils.

4. A dual air conditioning apparatus which comprises a pair of separate circulating systems for a liquefiable gas refrigerant that is cooled by compression, condensation and evaporation, and for a liquid aqueous ethylene glycol coolant that is cooled by cold outside air, each of which separate circulating systems includes different air cooling coils through which the respective refrigerant and liquid aqueous ethylene glycol coolant pass, means for preventing passing of liquefiable gas refrigerant and liquid aqueous ehtylene glycol coolant through the respective cooling coils at the same time, and a multiplicity of heat transfer fins, joined to both such air cooling coils, and adapted selectively to transfer heat to circulating fluids in such coils from air to be cooled by the air conditioning apparatus, such pair of separate circulating systems being incorporated together so that both such systems can be used simultaneously to cool the air by the refrigerant or liquid coolant therein or by either such system being so employed, and which dual air conditioning apparatus comprises a single heat exchanger for cooling circulating liquid aqueous ethylene glycol coolant by cold outside air, means for circulating said coolant through either or both of sets of coolant-containing cooling coils of the component systems, and means for circulating said coolant through the condensers of either or both of the component systems to condense refrigerant therein.

5. A dual air conditioning apparatus which comprises a pair of separate circulating systems for a liquefiable gas refrigerant that is cooled by compression, condensation and evaporation, and for a liquid aqueous ethylene glycol coolant that is cooled by cold outside air, each of which separate circulating systems includes different air cooling coils through which the respective refrigerant and liquid aqueous ethylene glycol coolant pass, means for preventing passing of liquefiable gas refrigerant and liquid aqueous ethylene glycol coolant through the respective cooling coils at the same time, and a multiplicity of heat transfer fins, joined to both such air cooling coils and adapted selectively to transfer heat to circulating fluids in such coils from air to be cooled by the air conditioning apparatus, which cooling coils are in sets of a plurality of multiple pass cooling coils containing refrigerant and a plurality of multiple pass cooling coils containing liquids aqueous ethylene glycol coolant, both of which sets of cooling coils make multiple passes through the multiplicity of heat transfer fins, through which heat is transferred from air being cooled to circulating fluid in such coils, which multiple pass refrigerant-containing cooling coils are substantially cylindrical and alternate with multiple pass coolant-containing coils of the sets at locations where the coils are joined to heat transfer fins, which are substantially rectangular and elongated, so as to improve the heat transfer efficiency when either refrigerant or coolant is circulated through its coolant coils, and wherein the ratio of the number of coolant-containing coolant coils to refrigerant-containing cooling coils is within the range of 1.3 to 1.7, with the tubes of the cooling coils being located in planes which are at an angle of 15° to 35° to the transverse axis of the rectangular fins, such pair of separate circulating systems being incorporated together so that both such systems can be used simultaneously to cool the air by the refrigerant or liquid coolant therein or by either such system being so employed, with the same coolant being circulatable through the coolant-containing sets of cooling coils of either or both of the component systems and with the same coolant being circulatable through the condensers of either or both of the component systems to condense the refrigerant therein, and which dual air conditioning apparatus comprises a single heat exchanger for cooling circulating aqueous ethylene glycol coolant by cold outside air and means for circulating said coolant through either or both of the sets of coolant-containing coils of the component systems.

6. A dual air conditioning apparatus according to claim 5 wherein the aqueous ethylene glycol includes sufficient ethylene glycol to prevent freezing at a temperature of −30° C., the refrigerant is a chlorofluoro lower hydrocarbon, the cooling coils are of copper and the fins are of aluminum.

* * * * *